US006309245B1

(12) United States Patent
Sweeney

(10) Patent No.: US 6,309,245 B1
(45) Date of Patent: Oct. 30, 2001

(54) RF AMPLIFIER ASSEMBLY WITH RELIABLE RF PALLET GROUND

(75) Inventor: Richard E. Sweeney, Rancho Santa Margarita, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 0 days.

(21) Appl. No.: 09/739,947

(22) Filed: Dec. 18, 2000

(51) Int. Cl.[7] ..... H01R 31/08

(52) U.S. Cl. ..... 439/507; 361/728; 330/66; 333/35

(58) Field of Search ..... 439/507; 361/728, 361/736, 799, 807; 330/66; 333/35, 246

(56) References Cited

U.S. PATENT DOCUMENTS

| | | | | |
|---|---|---|---|---|
| 3,879,690 | * | 4/1975 | Golant et al. | 333/204 |
| 4,288,759 | * | 9/1981 | Stover | 333/24 R |
| 4,423,388 | | 12/1983 | Crescenzi, Jr. et al. . | |
| 4,535,307 | * | 8/1985 | Tsukii | 333/35 |
| 4,641,106 | | 2/1987 | Belohoubek et al. . | |
| 4,663,599 | | 5/1987 | Patch . | |
| 5,539,254 | * | 7/1996 | Eytcheson et al. | 257/691 |
| 5,650,652 | | 7/1997 | Mizutani et al. . | |
| 5,726,605 | | 3/1998 | Morse et al. . | |
| 5,767,743 | | 6/1998 | Morimoto et al. . | |
| 5,789,982 | | 8/1998 | Uscategui et al. . | |
| 5,874,859 | | 2/1999 | Amachi et al. . | |
| 5,986,505 | | 11/1999 | Torgeson et al. . | |

* cited by examiner

*Primary Examiner*—Brian Sircus
*Assistant Examiner*—Brian S. Webb
(74) *Attorney, Agent, or Firm*—Myers, Dawes & Andras LLP

(57) ABSTRACT

An RF pallet ground comprises overhangs disposed at opposite ends. Each overhang includes a downwardly protruding ledge and a notch defined in a bottom surface of the pallet. The ledges and notches extend from one side of the pallet to the other. The ledge provides a positive connection directly to ground. The ledge has a length shorter than the length of the main body of the pallet. Fasteners are positioned on either side of an RF trace on the pallet, allowing positive pressure to be applied to the ground through the ledge.

18 Claims, 3 Drawing Sheets

RF AMPLIFIER ASSEMBLY WITH RELIABLE RF PALLET GROUND

BACKGROUND OF THE INVENTION

1. Field of the Invention

The present invention relates to RF power amplifiers and mounting systems for such amplifiers. More particularly, the present invention relates to RF power amplifiers mounted on pallet structures.

2. Description of Prior Art and Related Information

RF power amplifiers require careful design of all RF signal lines to avoid RF energy loss. In particular, RF signal lines require a consistent connection to ground in order to properly propagate RF signals along the signal line. If the signal line is not properly grounded along the entire signal path, RF signals may reflect, radiate or generate heat. In addition, the distance of the path to ground is important. A longer path to ground distance increases the probability of an RF signal radiating or reflecting as opposed to a shorter path. This consideration becomes more significant at both higher power and frequencies, and in particular the frequency ranges common in modern cellular base station applications.

Conventionally, RF gain blocks are structurally arranged on a pallet which acts as a substrate and heat sink for the associated RF circuitry. These pallets are mounted in a housing base and electrical connections between the RF and DC lines on the pallet and associated traces on the base must be made. The RF connection point is most critical and is typically referred to as the RF launch. The pallet is designed to keep acceptable tolerances of the over hang of the RF gain blocks and the base to provide a consistent ground across the pallet/base connection. A screw at each RF launch is typically employed to mount the pallet to the base and provide a positive ground connection. Despite these efforts to control the pallet/base connection, existing pallet structures, while providing an RF ground, do not provide a fixed and positive RF ground, which is consistent from amplifier to amplifier and over time and temperatures.

One cause of this problem with existing RF pallet structures is that the RF ground is not consistent when moved from a test fixture to a final product. When moving the pallet to a production amplifier assembly, the RF ground changes in distance and location relative to the RF traces and RF launch for various reasons. For example, when the thinned pallet landing is torqued by the machine driving of the screw, the landing may warp. This will change the RF ground location. Also, machine tolerances may be varied in production environments.

Another cause of variations in RF ground is due to changes introduced by temperature variations. Such temperature changes will cause relative movement of the pallet and base since the pallet has the heat generating power transistors mounted thereon. Also, the pallet and base may have different thermal coefficients of expansion. Furthermore, over time thermal cycling may cause the screw at the RF launch to loosen. All these factors cause the specific RF ground location relative to the RF traces at the pallet/base connection to change in an unpredictable way.

Another important consideration in RF power amplifiers is maintaining correct phase relations between RF signal paths. This requires each path to have a consistent known reactance. A problem with existing RF pallet structures is the inherent existence of unpredictable parasitic reactances. The reactances inherent to the conventional structures are introduced because of variables such as junctions of ground contact locations and changes over temperature. The junctions typically are located in phase dependent (high RF power) locations and are susceptible to phase and amplitude errors, return loss changes and possible coupling issues. As a result, immediate negative effects to tuning are created.

Furthermore, some existing RF pallet structures require manual labor in installing pallet to base coupling mechanisms. This leads to increased cost of manufacturing.

Thus, the need exists for an RF amplifier assembly having a reliable RF pallet ground which reduces RF signal losses. A need further exists for an RF pallet design where parasitic reactances are substantially eliminated and the immediate negative effects to tuning can be minimized and compensated over temperature while a need further exists for an RF pallet design compatible with low manufacturing costs.

SUMMARY OF THE INVENTION

In accordance with the teachings of this invention, an RF amplifier assembly is provided which employs a reliable RF pallet ground which reduces RF signal losses. Furthermore, a fixed and positive RF pallet is provided that minimizes inherent parasitic reactances introduced because of ground contact location and changes over temperature. As a result, susceptibility to phase and amplitude errors, return loss changes and possible coupling issues are decreased and, as a result, the immediate negative effects to tuning can be minimized and compensated over a range of operating temperatures.

In one aspect, an RF amplifier assembly is provided. The assembly comprises a base and an RF pallet. The base comprises a recess and a pallet contact portion. The RF pallet is configured in the recess. The pallet has a first end, a second end, and a first overhang disposed at the first end. The overhang comprises a notch and a downwardly protruding ledge. RF amplifier circuitry is configured on the pallet. The pallet contact portion is coupled to the overhang of the pallet. In a preferred embodiment, the RF pallet further comprises a second overhang disposed at the second end. The second overhang is preferably symmetrical to the first overhang.

In a preferred embodiment, the pallet contact portion comprises a shelf adapted to support the overhang of the pallet to provide an RF ground connection. The assembly further comprises an RF connector coupled to the pallet and the pallet contact portion. The RF connector comprises first and second end portions. The first end portion of the RF connector is coupled to a top surface of the pallet, and the second end portion is coupled to a top surface of the pallet contact portion. The RF connector preferably comprises a jumper connector, which may be an omega shaped connector. The pallet further comprises an RF trace extending from the connector and a fastener disposed adjacent to the RF trace to maintain positive contact of the ledge with the pallet contact portion. The fastener may, for example, comprise a screw.

In a preferred embodiment, the assembly further comprises a housing, wherein the housing comprises the base. The housing may be composed of a same material as the pallet; for example, an aluminum alloy. Alternatively, the pallet may be composed of a material with a higher thermal conductivity, such as copper.

In another aspect, a pallet is provided for use in an RF amplifier assembly. The pallet comprises a first end, a second end, a first overhang disposed at the first end, a top major surface, a bottom major surface, and RF amplifier circuitry configured on the top major surface. The first overhang comprises a notch and a downwardly protruding ledge. The ledge comprises a first downward length that is smaller than a second downward length between the top major surface and the bottom major surface. The pallet further comprises a notch surface. The ledge has a bottom ledge surface disposed above the bottom major surface and below the notch surface. The pallet further comprises first and second side edges. The notch and ledge extend from the first side edge to the second side edge.

A method is also provided for making an RF amplifier assembly having a reliable connection of RF ground. The method comprises providing a pallet having a downwardly protruding ledge at one end, providing an RF amplifier module on the pallet, providing a pallet contact portion having a shelf adapted to support the ledge of the pallet, coupling the pallet to the pallet contact portion, and coupling an RF connector to the pallet and the pallet contact portion. The coupling the RF connector to the pallet and the pallet contact portion may comprise fastening one end on top of the pallet and another end on top of the pallet contact portion, thus providing full contact with RF traces and positive contact between the ledge and the pallet contact portion.

The invention, now having been briefly summarized, may be better appreciated by the following detailed description.

DETAILED DESCRIPTION OF THE PREFERRED EMBODIMENTS

In the detailed description that follows, it should be appreciated that like element numerals are used to describe like elements illustrated in one or more of the figures.

Figure 1:
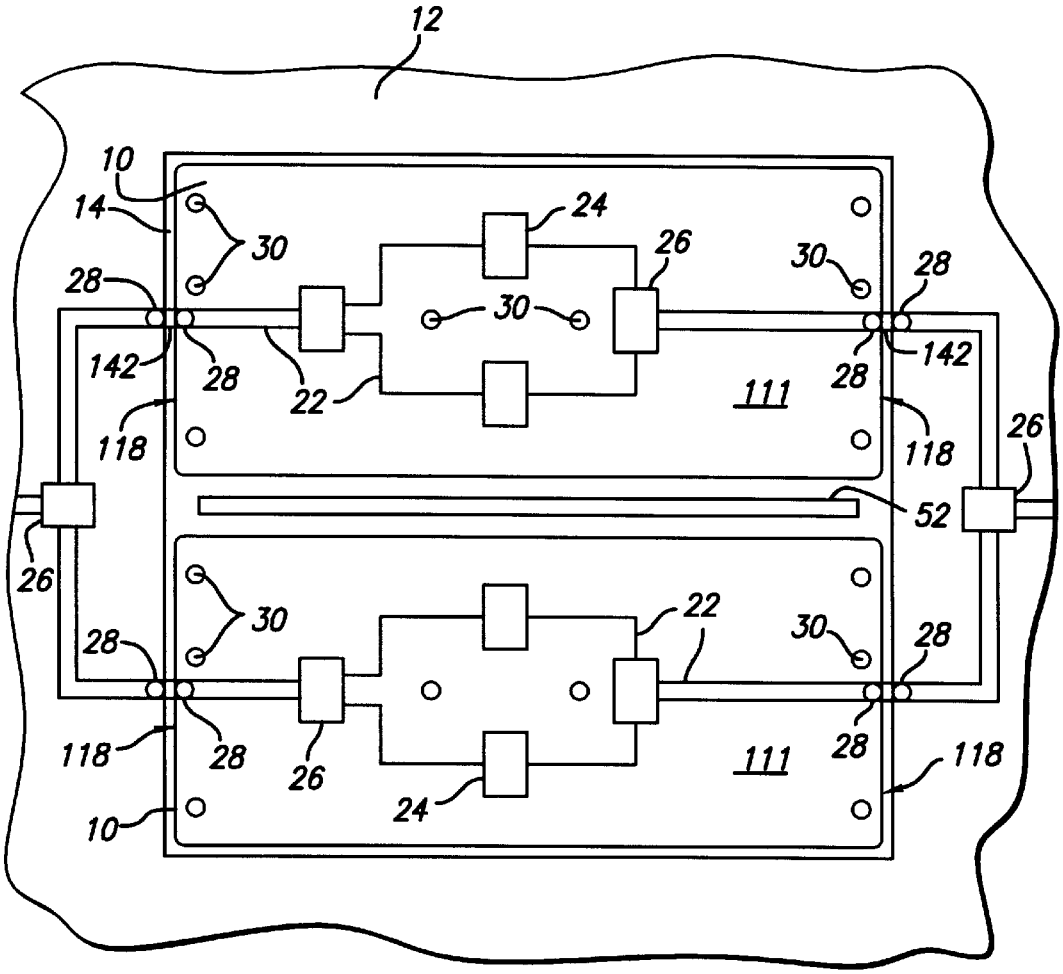
FIG. 1 is a schematic diagram showing a portion of an RF amplifier assemply having two RF pallets according to a preferred embodiment of the present invention.
Figure 2:
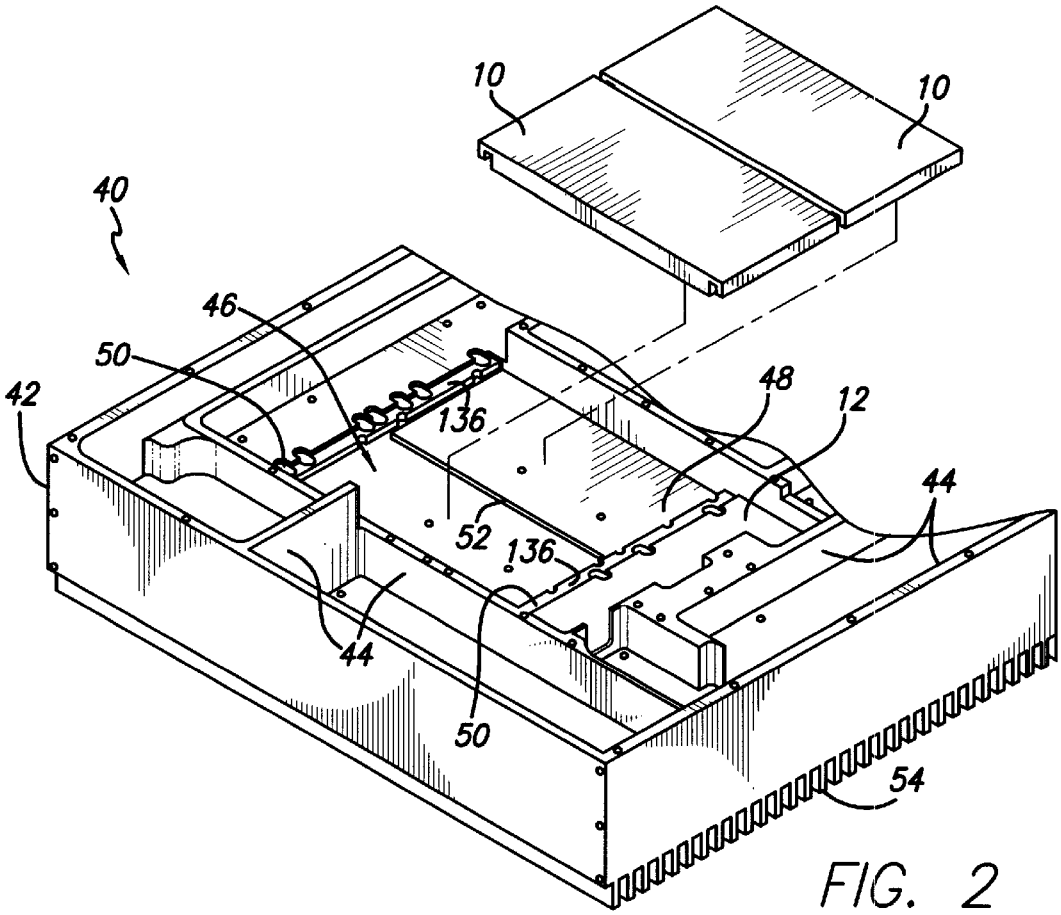
FIG. 2 is an exploded, perspective view of an RF amplifier assembly according to the invention.
Figure 3:
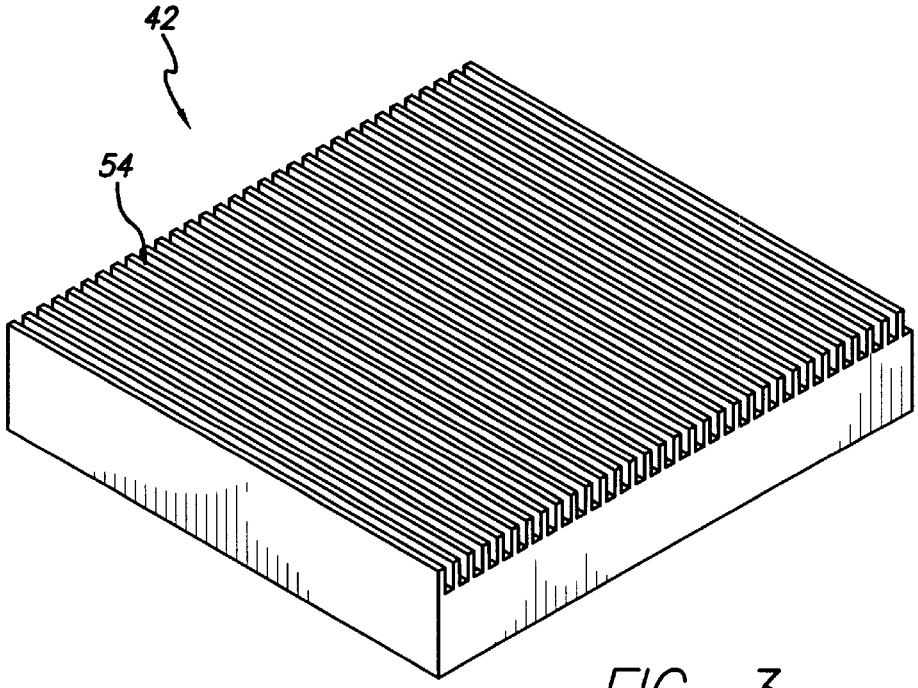
FIG. 3 is a bottom perspective view of a housing of the RF amplifier assembly.

FIG. 1 is a top view of a portion of an RF amplifier assembly and FIG. 2 is an exploded perspective view of the RF power amplifier assembly 40 according to the invention. FIG. 3 is a bottom view of the assembly housing.

The illustrated RF amplifier employs two RF gain modules in the form of RF amplifier circuitry, associated components, and traces on two RF pallets, or RF pallet modules, 10 configured in a recess 14 of a base 12. Although two RF gain modules on two RF pallets are illustrated, it should be appreciated that a single RF gain module and pallet, or more than two, may equally be employed. Conductive traces 22 and electronic components comprising the circuitry of the RF gain module are formed on a top surface 111 of each pallet 10. Although the illustrated components are RF amplifier IC's 24 and RF signal splitters 26, additional components may be provided as known to those skilled in the art. RF launches 28 are disposed adjacent to ends 118 of each pallet 10. Connectors 142 connect the RF launches 28. Screws 30 or other suitable mounting elements couple the pallets 10 to the base 12. Preferably, at least one screw 30 is configured adjacent each RF launch 28.

The assembly 40 preferably includes a housing 42 comprising a plurality of compartments defined by partitions 44. The portion of the assembly shown in FIG. 1 corresponds to an RF compartment 46. The recess 14 is defined by a surface 48 adapted to support bottom surfaces of the RF pallets 10. The compartment 46 further comprises shelves 136 at each end 50 adapted to contact the ledges of the pallets 10 as described in more detail below. The screws are received by cavities formed in the shelves 136 of the base 12. Although one RF compartment 46 sized to receive two pallets 10 disposed side by side is shown in FIG. 2, additional RF components may be provided. A RF barrier wall 52 is formed in the compartment surface 48 between the areas where the pallets 10 lay. The mounting of wall 52 may employ the teachings of U.S. patent application Ser. No. 09/435,953 filed on Nov. 9, 1999, the disclosure of which is incorporated herein by reference. Alternatively, the RF pallets 10 may be formed in separate recesses in separate RF shielding compartments.

The additional compartments may house various RF amplifier control circuitry and such compartments are isolated from the RF compartment by walls 44. The electronics of the RF amplifier and control circuitry may include the disclosure provided by U.S. Pat. No. 5,796,304 to Gentzler, which is incorporated by reference as though fully set forth herein.

FIG. 3 is a bottom perspective view of the housing 42. Preferably, the housing 42 includes a heat sink 54 for dissipating heat from the pallets.

Figure 4:
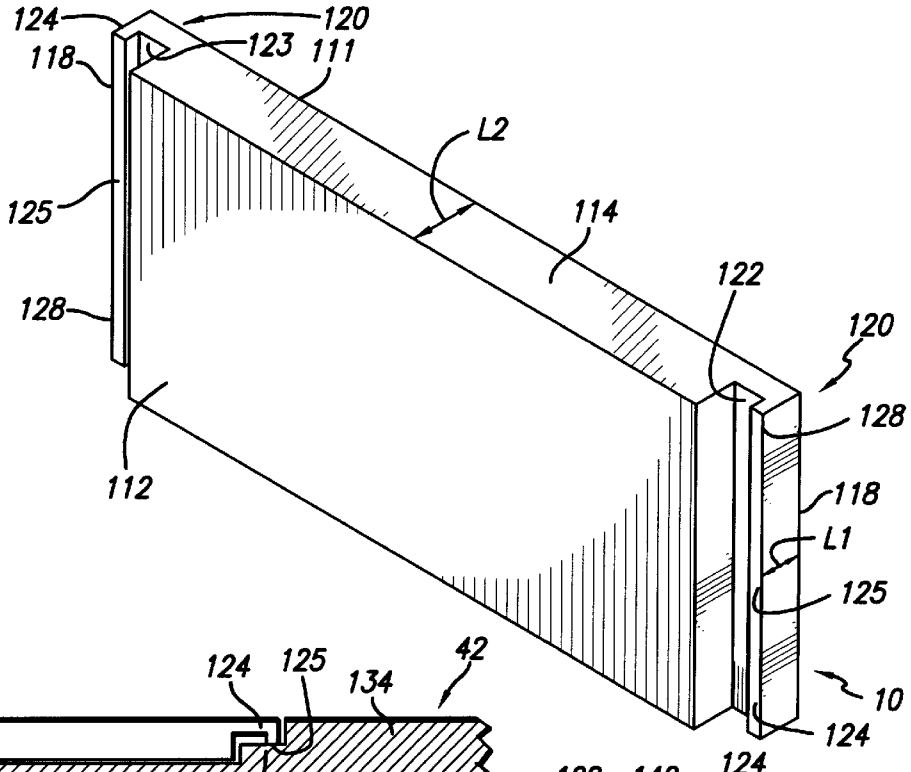
FIG. 4 is a bottom perspective view of an RF pallet according to the present invention.

FIG. 4 is a bottom perspective view of a single pallet 10. The pallet 10 has a top major surface 111, a bottom major surface 112, pallet side edges 114, and end edges 118. The pallet 10 comprises an overhang 120 at each end edge 118. Since the edges 118 are symmetrical, only one end edge 118 will be described in detail for brevity purposes. A notch 122 is defined along the width of each end edge 118 such that an outer ledge 124 is formed. The notch 122 includes a notch surface 123. The notch 122 is disposed interiorly, or medially, with respect to the ledge 124.

Disposed adjacent the end edges 118, the ledge 124 has a bottom ledge surface 125. The ledge 124 protrudes, or extends, downwardly such that the bottom ledge surface 125 is disposed on a plane between that of the bottom major surface 112 and the notch surface 123. Alternatively stated, when the pallet 10 is operatively disposed in the recess 14, the ledge 124 extends downwardly such that its bottom surface 125 is disposed beneath the notch surface 123 and above the bottom major surface 112. Thus, the ledge 124 has a downward length "L1" that is shorter than the downward length "L2" of the pallet side edge 114. Alternatively stated, the ledge 124 has a downward length "L1" smaller than the downward length "L2" defined between the top major surface 111 and the bottom major surface 112. The notch 122 and ledge 124 extend prismatically from one side edge 114 to the other. The pallet 10 is preferably composed of a metal or metals with sufficient thermal transfer and electrical grounding properties such as copper or an aluminum alloy. Other metal alloys may also be employed. In a preferred embodiment, the pallet 10 is composed of the same material as the housing 42, shown in FIGS. 2 and 3, such as an aluminum alloy.

Figure 5:
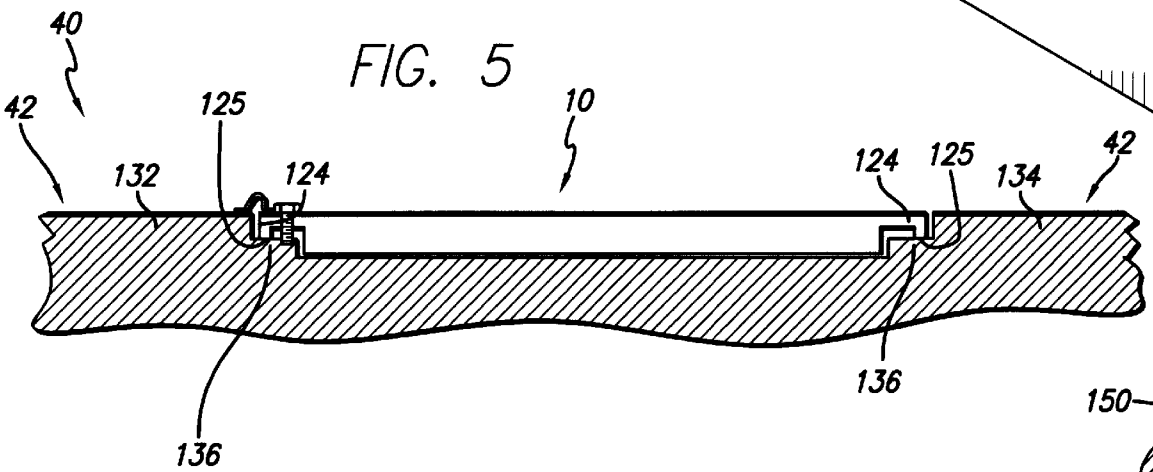
FIG. 5 is a side view of an RF pallet shown on a heat sink according to an embodiment of the present invention.

FIG. 5 is a side view of a portion of an RF power amplifier assembly 40 showing the pallet 10 in an operative configuration on the base. Pallet contact portions 132,134 are disposed at both sides of the pallet 10. In a preferred embodiment, the pallet contact portions 132, 134 are formed as an integral part of the housing 42. Thus, the pallet contact portions 132, 134 along with the rest of the housing 42, may be composed of a metal or metals with sufficient thermal transfer and electrical grounding properties. In a preferred embodiment, the housing 42 is composed of an aluminum alloy. The pallet contact portions 132,134 comprise extended portions, or shelves, 136 which are fit to support the ledges 124 of the pallet 10. The bottom ledge surfaces 125 of the pallet 10 rest on top of the shelves 136 of the pallet contact portions 134. Thus, the pallet 10 makes a repeatable, reliable connection to RF ground as it sits on the pallet contact portion shelves 136. This connection is enhanced by fasteners 30, such as screws, described below in relation to FIG. 6.

Figure 6:
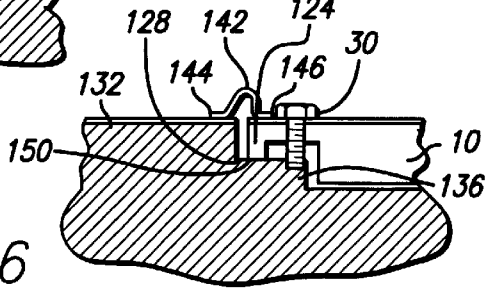
FIG. 6 is a cross-sectional side view of the coupling of the RF pallet to the housing base according to an embodiment of the present invention.

FIG. 6 is a detailed view of the coupling between the pallet 10 and one pallet contact portion 132. An RF connector 142, which may be an omega shaped jumper connector, provides an electrical connection between the pallet contact portion 132 and the pallet 10. A similar RF connector may be provided between the opposite pallet contact portion 134 and the pallet 10. A first end 144 of the RF connector 142 is coupled to a first trace on the surface of the pallet contact portion 132 while the other end 146 of the RF connector 142 is coupled to a second trace on the top surface of the pallet 10. The RF connector 142 thus provides electrical contact of the RF traces adjacent the RF launches 28. Fasteners 30, such as screws, are located at the RF trace to maintain positive contact of the ledges 124 of the pallet 10 with the pallet contact portions 132, 134 and to minimize the distance to ground from the traces. The fasteners 30 also securely connect the pallet 10 to the housing 42, and the contact position is relatively insensitive to temperature changes. It will be appreciated that the RF connector 142 allows an RF signal to propagate therethrough while the fasteners 30 and the ledge 124 provide an adjacent ground connection that minimizes parasitic reactances.

Thus, it will be appreciated that the overhangs 120 provide a fixed and positive RF ground that minimizes inherent parasitic reactances introduced as a result of ground contact location and fluctuations in temperature. A more reliable ground connection is provided, in part, by the ledges 124, each of which also serves as a fulcrum should the pallet 10 torque. As obvious from FIG. 6, should the pallet 10 be torqued or even rotate slightly with respect to the pallet contact portions 132, 134 the ledge 124 provides constant contact between pallet 10 and the pallet contact portion 132. Furthermore, in FIG. 6, the point of ground 150 is defined by contact point between the outer edge 128 of the ledge 124 and the shelf 136. As a result, a shorter path to ground is provided, thereby making the ground connection even more reliable.

The pallet according to the invention decreases susceptibility to phase and amplitude errors, return loss changes and possible coupling issues are decreased. This thus minimizes the potential negative effects to tuning prior to assembly. Also, negative effects over temperature ranges are reduced. Further, the fixed and positive RF ground allows the ground to be consistent while being moved from a fixture to a final product. The ground does not change in distance and location when both the thinned landing is torqued and machine tolerances are varied. Another advantage of the structure is that it costs less because it is adapted for automated assembly reducing costs of manual labor involved in prior art alternatives.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. An RF amplifier assembly comprising:

a base having a recess and a pallet contact portion;

an RF pallet configured in the recess and having a first end, a second end, a first overhang disposed at the first end, the overhang comprising a notch and a downwardly protruding ledge; and RF amplifier circuitry configured on the pallet, wherein the pallet contact portion is coupled to the overhang of the pallet.

2. The assembly of claim 1, wherein the RF pallet further comprises a second overhang disposed at the second end.

3. The assembly of claim 1, wherein the pallet contact portion comprises a shelf adapted to support the overhang of the pallet to provide an RF ground connection.

4. The assembly of claim 1, further comprising an RF connector coupled to the pallet and the pallet contact portion.

5. The assembly of claim 4, wherein:

the pallet comprises a first RF trace disposed on a top surface thereof; and the RF connector comprises first and second end portions, the first end portion coupled to the first RF trace and the second end portion coupled to a second RF trace on a top surface of the pallet contact portion.

6. The assembly of claim 5, wherein the RF connector comprises a jumper connector.

7. The assembly of claim 6, further comprising a fastener disposed adjacent to the first RF trace to maintain positive contact of the ledge with the pallet contact portion.

8. The assembly of claim 7, wherein the fastener comprises a screw.

9. The assembly of claim 1, further comprising a housing, wherein the housing comprises the base as an integral portion thereof.

10. The assembly of claim 9, wherein the housing is composed of a same material as the pallet.

11. A RF gain module for use in an RF amplifier assembly, comprising:

a pallet having:

a top major surface;

a bottom major surface;

a first end;

a second end;

a first overhang disposed at the first end, the first overhang comprising a notch and a downwardly protruding ledge; and RF amplifier circuitry configured on the top major surface of the pallet.

12. The module of claim 11, wherein the pallet is composed of an aluminum alloy.

13. The module of claim 11, wherein the ledge comprises a first downward length that is smaller than a second downward length between the top major surface and the bottom major surface.

14. The module of claim 11, further comprising a notch surface, wherein:

the ledge has a bottom ledge surface disposed above the bottom major surface and below the notch surface.

15. The module of claim 11, further comprising first and second side edges, wherein the notch and ledge extend from the first side edge to the second side edge.

16. A method of making an RF amplifier assembly having a reliable connection of RF ground comprising:

providing a pallet having a downwardly protruding ledge at one end;

providing an RF amplifier module on the pallet;

providing a pallet contact portion having a shelf adapted to support the ledge of the pallet;

coupling the pallet to the pallet contact portion; and coupling an RF connector to the pallet and the pallet contact portion.

17. The method of claim 16, wherein coupling the RF connector to the pallet and the pallet contact portion comprises fastening one end on top of the pallet and another end on top of the pallet contact portion.

18. The method of claim 17, wherein coupling the RF connector to the pallet and the pallet contact portion comprises providing full contact of an RF trace and positive contact between the ledge and the pallet contact portion.

* * * * *